US006527131B1

(12) United States Patent
Bröckelmann et al.

(10) Patent No.: US 6,527,131 B1
(45) Date of Patent: Mar. 4, 2003

(54) CRANE WITH A TELESCOPIC BOOM

(75) Inventors: Gerd Bröckelmann, Unna (DE); Hans-Dieter Willim, Unterweiler (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 09/628,379

(22) Filed: Jul. 31, 2000

(30) Foreign Application Priority Data

Jul. 30, 1999 (DE) ..... 299 13 333 U
Feb. 24, 2000 (DE) ..... 200 03 355 U

(51) Int. Cl.[7] ..... B66C 23/04
(52) U.S. Cl. ..... 212/292; 212/349; 52/118
(58) Field of Search ..... 212/292, 347, 212/348, 349; 52/118

(56) References Cited

U.S. PATENT DOCUMENTS 6,164,468 A * 12/2000 Erdmann ..... 212/348
6,189,712 B1 * 2/2001 Conrad et al. ..... 212/292
6,206,213 B1 * 3/2001 Conrad ..... 212/292
6,216,895 B1 * 4/2001 Erdmann et al. ..... 212/292

FOREIGN PATENT DOCUMENTS

| | | |
|---|---|---|
| DE | 19641193 | 3/1998 |
| DE | 196 31 547 | * 4/1998 |
| DE | 19824671 | 12/1998 |
| DE | 198 24 672 | * 12/1998 |
| EP | 0661234 | 7/1995 |

* cited by examiner

*Primary Examiner*—Thomas J. Brahan
(74) *Attorney, Agent, or Firm*—Dilworth & Barrese LLP

(57) ABSTRACT

Segments can be telescoped out of the base boom with boom guides of a telescopic boom of a crane, which in either their extended or retracted positions are locked by locking pins. After releasing the locking pin connections, the segments can be moved in and out with a single-stage hydraulic piston-cylinder unit, one end of which is attached to the boom guide through two strokes so that each segment to be moved in or out is coupled either to the inside or the outside end area of the movable part of the piston-cylinder unit. In order to obtain a simpler structure, a movable ring or a movable pipe with a coupling device to couple the segments is placed on the cylinder by the piston rod fastened to the boom guide piece, which can be locked to either the internal or the external end area of the cylinder.

14 Claims, 5 Drawing Sheets

0/0

0/50%

0/50%

0/50%

CRANE WITH A TELESCOPIC BOOM

BACKGROUND OF THE INVENTION

The invention concerns a crane with a telescopic boom whose segments, which can be telescoped out of a base boom with a boom guide piece, are locked in their extended or retracted positions by locking pins, and after the release of the locking pin connectors, can be extended and retracted with a single-stage hydraulic piston-cylinder unit, one end of which is fastened to the boom guide piece with two strokes so that each segment which is to be extended or retracted is coupled either with the inside or with the outside end area of the movable portion of the piston-cylinder unit.

From DE 198 24 671 A1, a telescopic boom of this type is known, in which either the piston rod or the cylinder of the piston-cylinder unit is attached to the attachment piece and the movable part of the piston-cylinder unit, namely in some cases the cylinder and in other cases the piston rod, is provided at its inner and outer ends with a securing and locking unit which can be coupled with grooves in the telescoping segments. If the securing and locking unit is located on the piston rod on the boom securing part, it is provided at its front end with a guide and pulling device running parallel to the cylinder which, at its inner end, carries a securing and locking unit.

The known telescopic boom therefore has a relatively complex design so that, on the inner and outer end of the cylinder and on the outer end of the piston rod and on the inner end of a guide and pulling device connection with it, securing and locking units are placed, which must therefore be present in duplicate.

SUMMARY OF THE INVENTION

The problem to be solved by the invention is, therefore, to create a crane with a telescopic boom of the type indicated at the beginning, which has a simpler structure.

According to a first embodiment, this problem is solved, according to the invention, by the fact that, with the piston rod fastened to the boom guide piece, a movable ring or a movable sleeve is guided on the cylinder with a coupling device to couple to the segments which can be locked both to the inner and the outer end area of the cylinder.

The movable coupling device can, in this connection, consist of two opposed pistons which can move in and out, which move in corresponding grooves or holes in the segments and which are known from EP 0 661 234 A1. The pin connections, which lock together the individual segments, can also be designed in such a manner as described in EP 0 661 234 A1. Furthermore, the movable ring or sleeve, which bears the coupling device, can also be provided with a device to unlock the pin connections which lock the individual segments together, as also described in EP 0 661 234 A1.

The telescopic boom in accordance with the invention makes it possible to move the individual segments upward and inward in two strokes, so that more favorable piston-cylinder units with respect to weight can be used, which also have a lower sensitivity to bending. The movable ring or the movable sleeve on the cylinder, which can surround the cylinder only partially, is locked to the cylinder in the end positions through known locking devices. In order to achieving locking and in order to release the locking and in order to move the coupling pins in and out and to move the devices which release the pin connections of the segments between themselves, hydraulic cylinders are provided, as an example, where the movable ring is provided with supply pipes.

An additional hydraulic cylinder can also be used to supply the locking unit, which simultaneously serves to move the locking unit onto the cylinder casing.

In order to make it possible to move the segments in and out in two strokes, these have in their central areas locking holes in which the arresting pin connections reach into the segments in a half-extended position. The distance of the locking holes of the individual segments from the central holes for the inner and outer holes correspond at the same time to the displacement length of the ring or sleeve on the cylinder.

According to another embodiment, the problem is solved according to the invention by the fact that when the cylinder is fastened to the boom guide piece with the outer end of the piston rod, a pipe concentric with the cylinder or lines parallel to it are fastened, which surround the cylinder and that on the pipe or the struts a movable ring or a movable piece is guided with a coupling device which can be coupled to the inner and outer end regions of the pipe or of the lines. At the same time, the ring or the movable piece is again provided with devices to release the locking pin connections corresponding to the first embodiment. Furthermore, the ring or the moving piece is provided with an energy supply which may consist of piping brought with it.

The oil supply for the locking unit as well as the moving unit can also be carried out through telescoping pipes inside the cylinders or through hoses.

If the ring or the sleeve or the moving part which bears the coupling device is not coupled to a segment during the movement of the moving part of the piston-cylinder unit, it is necessary to move it to the other end of the moving part and to lock it again there. For this purpose, in a further embodiment of the invention, a device is provided which retracts the ring or the moving part together with the coupling device from its outside position into the inside position, or vice versa.

It is advantageous to provide the cylinder casing or the pipe enclosing it, or the guides on its outer and inner end regions, with collars, shoulders or grooves with which the rings, sleeves or moving pieces can be connected releasably, for example, using claws or pins.

The guides can be provided with coupling devices with which the moving piece can be connected releasably, using counter-coupling devices.

BRIEF DESCRIPTION OF THE DRAWINGS

Sample embodiments of the invention are explained in greater detail, using the drawing. In it, the following are shown.

DESCRIPTION OF THE PREFERRED EMBODIMENTS

Figure 1:
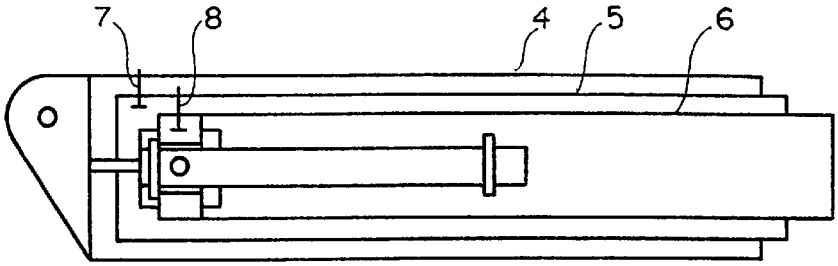
FIGS. 1–6 schematically illustrate a telescopic boom in accordance with the present invention, having a piston rod fastened to a boom guide piece in different positions of extension of the piston and cylinder therefor.

In the sample embodiment according to FIGS. 1 through 6, the piston rod 1 of the hydraulic piston cylinder unit 1, 2 is fastened to the boom guiding piece 3 of the basic boom 4, which forms the outside segment of the telescopic boom.

In the sample embodiment represented, only two segments 5, 6 can be extended from the basic boom 4, and retracted into it, which are locked to each other and to the basic boom 4 through standard locking pins 7, 8. On the cylinder 2, a sleeve 9 is movable but not rotatable in the axial direction, which is provided with claws 10 on both ends, which lock the sleeve 9 either with a ring collar 11 of the cylinder 2, in the manner shown in FIGS. 1 and 2, which is located on the inner end of the cylinder, or in the manner shown in FIGS. 3 and 4 to a ring collar 12, which is located on the end or bottom area of the cylinder 2.

The sleeve 9 is provided with hydraulically movable locking pins on opposite sides in the manner known from EP 0 661 234 A1, as a result of which the sleeve 9 can be locked to the inner end of the extendable segment, so that the segment to be moved can be extended or retracted in two strokes, where the sleeve is locked once to the inner end and once to the outer end of the cylinder.

The sleeve 9 is furthermore provided with a device to pull the locking pins 7, 8, also known for example from EP 0 661 234 A1, which are supplied with coupling pieces, for example plates, for coupling to the device, which are spring-fed in the direction of their extended locking position.

The sleeve 9 is provided with piping for the supply of power in a manner not represented, which on the one hand can lock and release the claws 10, and on the other hand, supply power, for example hydraulic oil, to the locking pins to couple the segments to the sleeve 9, and the device for pulling the pins 7, 8. The swinging claws may be provided with springs so as to snap automatically into their coupling position by means of suitable inclines.

Figure 2:
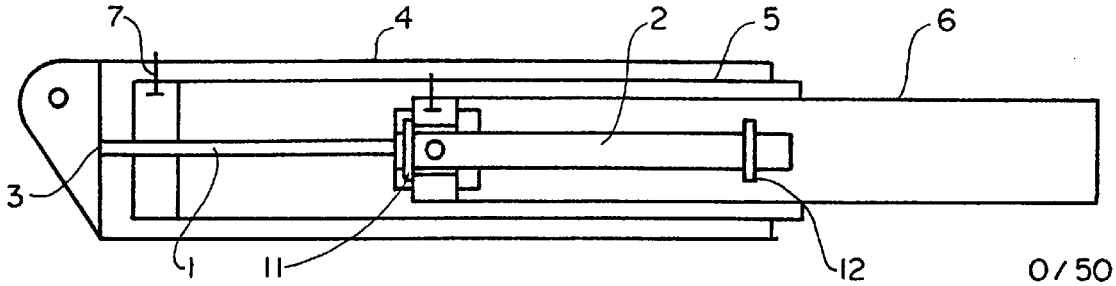
Figure 2A:
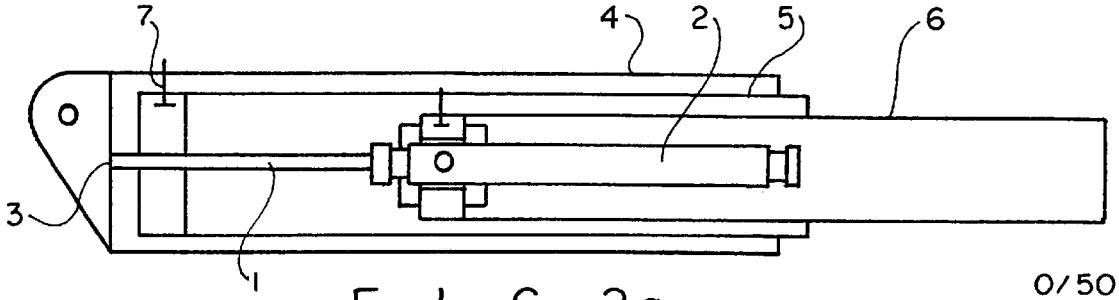
FIG. 2*a* is a schematic view of similar to FIGS. 2 in which the collar at the end of the cylinder has been replaced by a respective groove.
Figure 3:
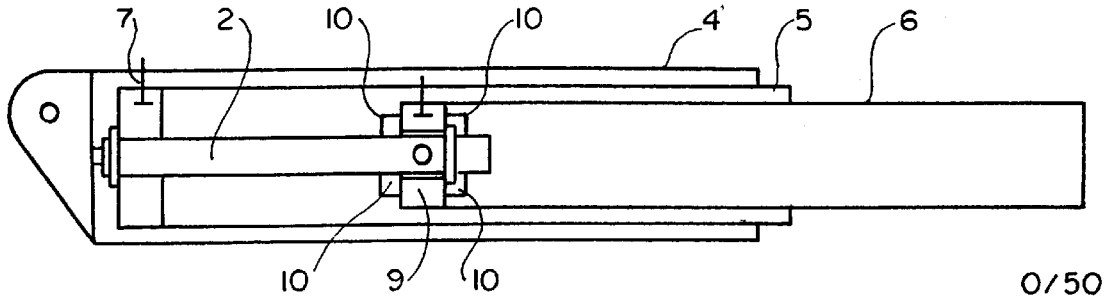
Figure 4:
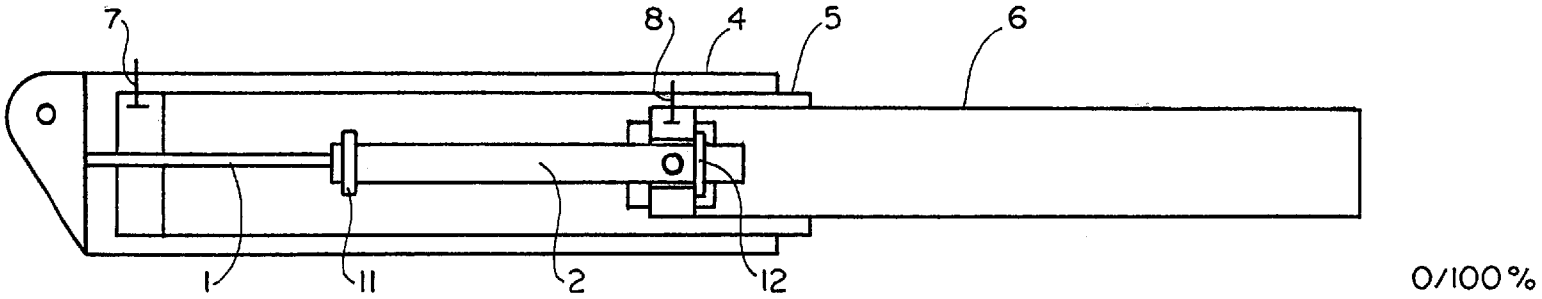

FIG. 2*a* illustrates an alternative embodiment of the cylinder of FIG. 2, wherein the collar to locked by the claws has been replaced by respective shoulders. In FIG. 2*a*, the inside and the outside positions to which the sleeve can be moved have been indicated. In FIG. 2*a*, the sleeve is actually shown in its inside position, whereas FIGS. 3 and 4 show the sleeve in the outside position thereof. FIG. 2*b* shows an alternative embodiment of the cylinder of FIG. 2, wherein the collars at the ends of the cylinder have been replaced by respective grooves. The respective grooves can receive the claws so that the sleeve is locked with respect to the cylinder.

The individual steps for extending the segments 5, 6 from the base boom 4 will now be explained using FIGS. 1 through 6. In FIG. 1, the segments 5, 6 are locked to each other through the pin 8, and the segment 5 is locked to the base boom 4 by pin 7. In order to extend segment 6, the cylinder 2 is coupled to the inside segment 6 by side locking pins of the sleeve 5, which is locked by the claws 10 to the inside ring collar 11 of the cylinder 2. After the locking pin 8 is pulled by the unlocking device on the collar 9, the cylinder 2 moves the segment 6 to its position extended by 50%, which is shown in FIG. 2. The segment 6 is again locked in this position by the locking pin 8 to the segment 5, which has a hole for this purpose in its central area. The claws located on the inside are released in this position and the cylinder 2 is retracted to its position, shown in FIG. 3, while the sleeve 9 remains locked through its side locking pins with the segment 6, so that the sleeve 9 must be moved to the extended position on the cylinder, during which the claws 10 are locked to the outside collar 12 of the cylinder 2. In this position, the locking pin 8 is again released, so that, in the manner shown in FIG. 4, the segment 6 can be extended completely out of the segment 5. In the extended position, the segment 5 is again locked to the outer end area of the segment 5 using the locking pin 8. After the release of the side locking pin, cylinder 2 is again moved to its retracted position shown in FIG. 5. Further, a device not shown is used to move the sleeve 9 to the inner end of the cylinder 2 and lock it there by means of the claws 10 with the collar 11. This device retracting into the sleeve 9 can, for example, consist of a cable, a gear drive, a friction wheel drive or a pressure piston-cylinder unit not represented.

Figure 5:
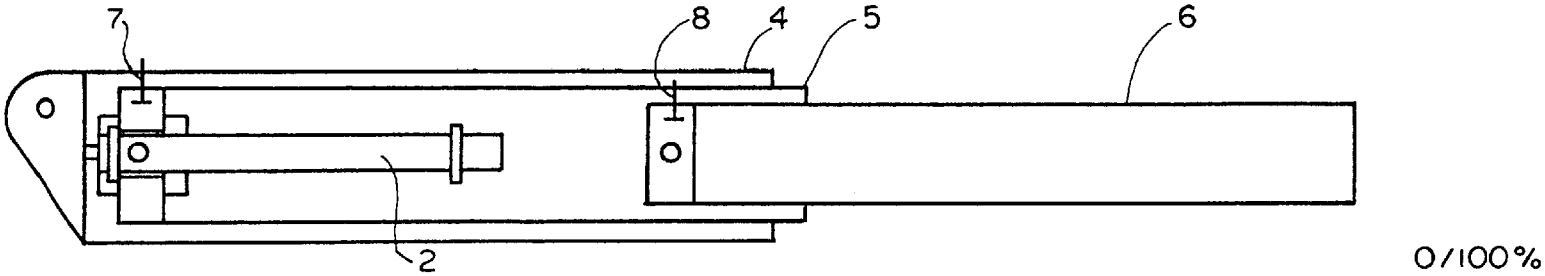
Figure 6:
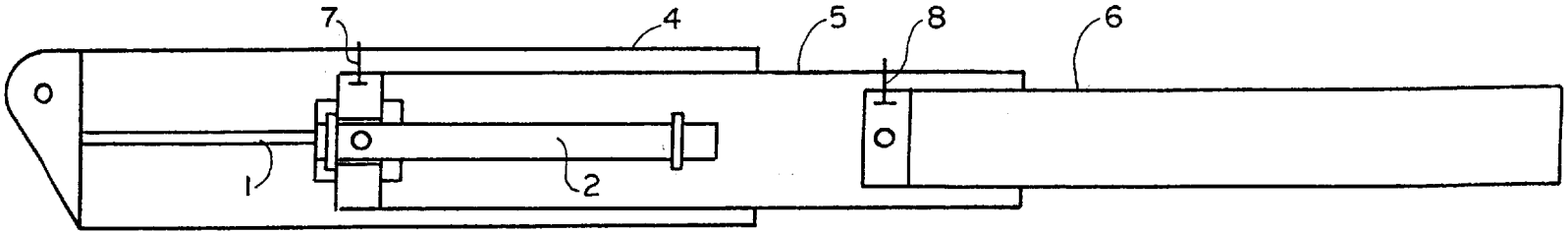
Figure 7:
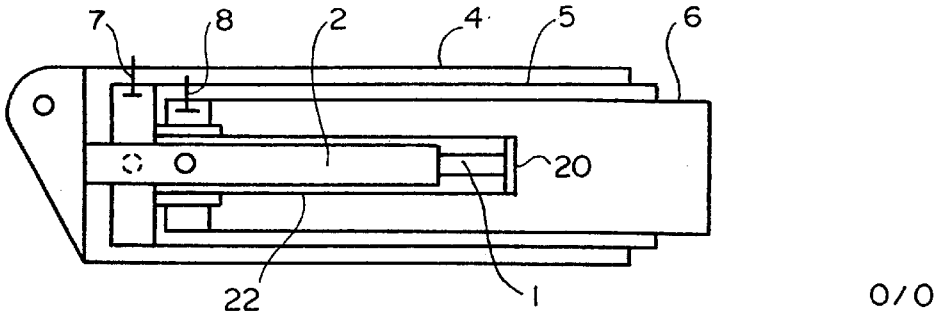
FIGS. 7–10 schematically illustrate corresponding positions of the telescopic boom having a cylinder attached to a boom guide piece.
Figure 8:
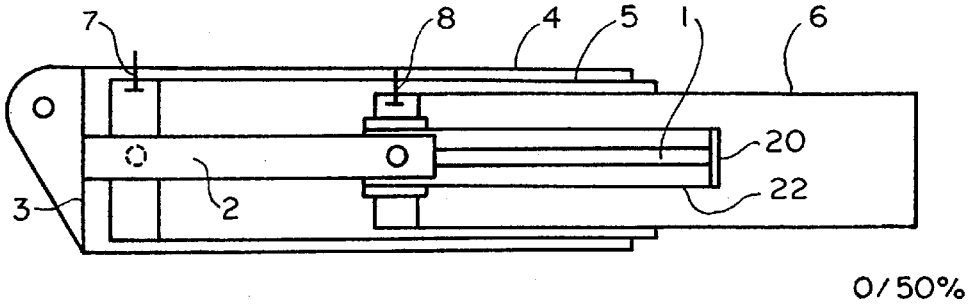
Figure 9:
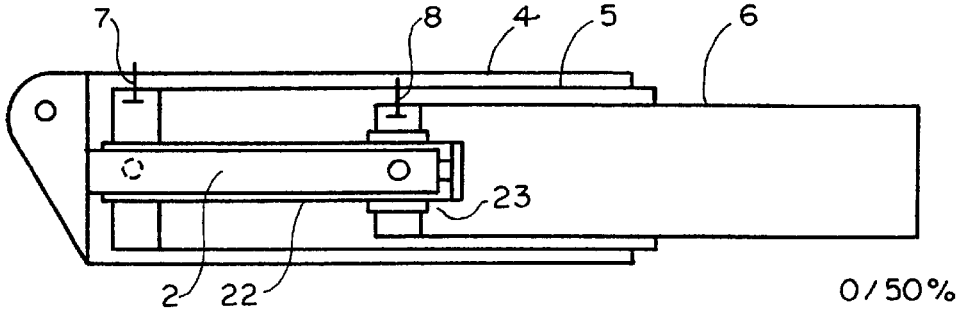
Figure 10:
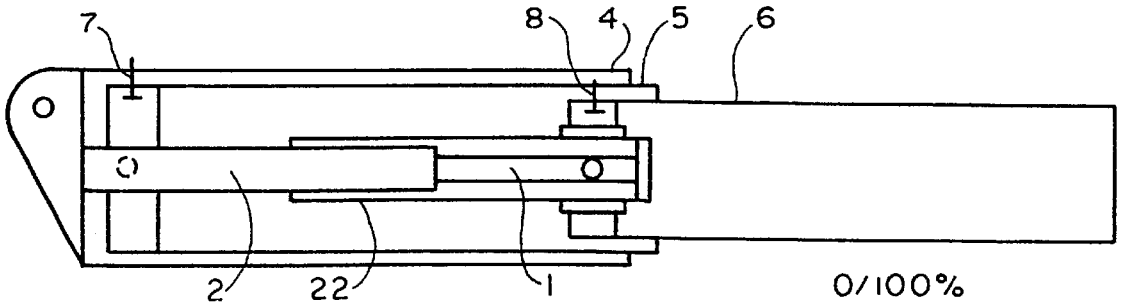
Figure 14:
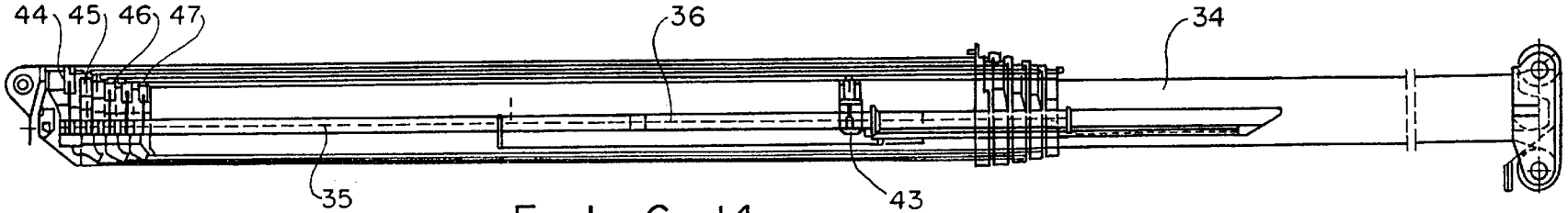
FIGS. 11 through 14 cross-sections through a telescopic boom in different positions, in which the sleeve bearing the coupling device is movable on the cylinder casing by the piston rod of an auxiliary cylinder, and FIG. 15 a schematic representation of the main cylinder which operates the individual segments, which is provided with an auxiliary cylinder to move the sleeve bearing the coupling device.
Figure 13:
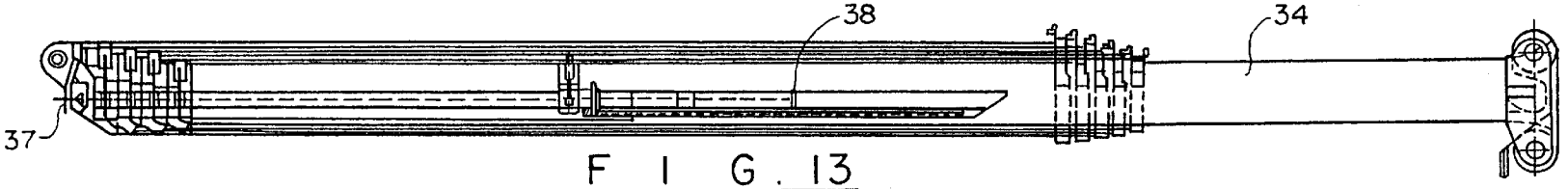
Figure 12:
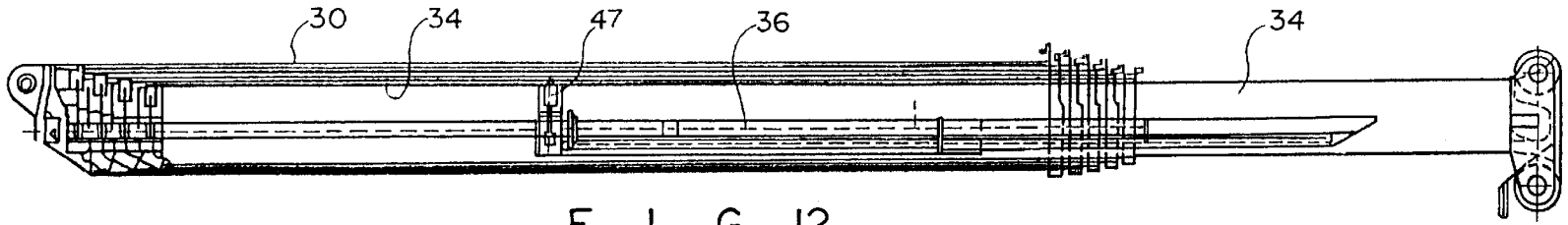

From the position shown in FIG. 5, the segment 5 is then extended out of the base boom 4, in a corresponding manner, where the first extension stroke is shown in FIG. 6.

As already stated, the invention can also be embodied in the manner shown in FIGS. 7 through 10, in which the cylinder 2 is connected with the boom guide piece 3. The piston rod 1 bears, on its outer end, a cross-wise yoke or a plate 20, to which a cage 22 is attached, whose inner end is brought movably over moving piece on the cylinder 2. This cage 20 can consist of a pipe or of a side struts which are placed movably on the cylinder 2. On the cage 22, there is a sleeve or a moving piece 23 applied movably which, like the sleeve 9 according to the embodiment of FIGS. 1 through 6, is provided with claws or locking devices to couple to the inner or outer end area of the cage, and with pins opposite one another, to couple to the segment to be extended or retracted, and with a device to pull the locking pins 7, 8. The method of extension and retraction is as in the sample embodiment according to FIGS. 7 through 10, in a corresponding manner as in the embodiment 1 through 6, but with the difference that the sleeve or the moving piece 23 can be coupled to the inner or outer end of the movable cage relative to the cylinder by means of the piston rod 2.

In both sample embodiments, the individual pins are mechanically locked to each other in such a manner that the segments either move together or the segment to be extended or retracted is locked to the movable portion of the piston cylinder unit.

Four telescoping segments 31 through 34 can be telescoped out of the telescopic boom in accordance with the invention, according to FIGS. 11 through 14, out of the boom guide piece 30. The piston rod 35 of the telescoping cylinder 36 is firmly attached to the foot piece 37 of the boom guide segment 30. The telescoping cylinder 36 is provided with side guides 39 overlapping its end 38 which are brought into the outer end pieces of the guide segment and into the telescoping segment in the usual manner, and prevent a rotation of the telescoping cylinder. On a transverse yoke 40, which connects the side guides 39, an auxiliary cylinder 41 is attached whose piston rod 42 pushes the sleeve 43 on the cylinder casing of the telescoping cylinder 36 between the end positions, locks it and releases it. The sleeve 43 bears the side locking pins to couple to the individual segments to be extended and retracted. Furthermore, the sleeve 43 bears a coupling piece to couple to the locking pins 44 through 47, to lock the individual telescoping segments to each other and to the boom guide segment.

Figure 11:
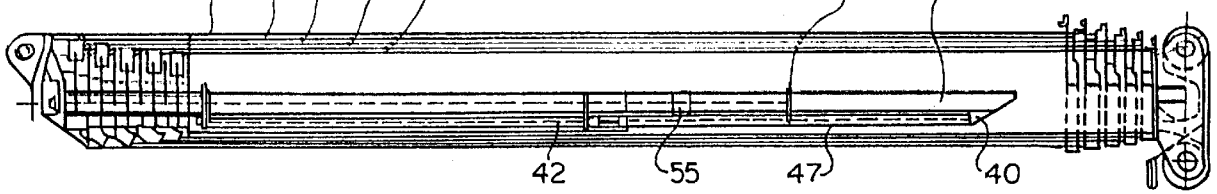

In FIG. 11, the auxiliary cylinder 41 has pushed inward the sleeve 43, provided with the coupling device, with its piston rod 42, into which sleeve the side locking pins are coupled with the inner segment 34 to be extended. After pulling and thereby unlocking the locking pins 47, the inner segment can be moved by the telescoping cylinder 36 in its half-extended position, shown in FIG. 12. Subsequently, the locking pin 47 is locked with a central hole of the segment 46, so that after the release of the locking pin which serves to move the telescoping segments sideward, cylinder 36 can be retracted into the position shown in FIG. 13. The inner telescoping segment 34 is then moved outward from this position through a new extension of the telescoping cylinder into its extended position, shown in FIG. 14. In this position, the inner telescoping segment 34 is then again locked with the telescoping segment 33 which surrounds it. Subsequently, the side pins are inserted and the telescoping cylinder 36 is again moved to its inner position to couple with the next telescoping segment 33, where the auxiliary cylinder 41, by extending its piston rod 42, moves the sleeve 43 at passing speed to the other end of the cylinder casing pipe, from which piston rod extends from the telescoping cylinder 36. The following telescoping segments are extended in a corresponding manner.

Figure 15:
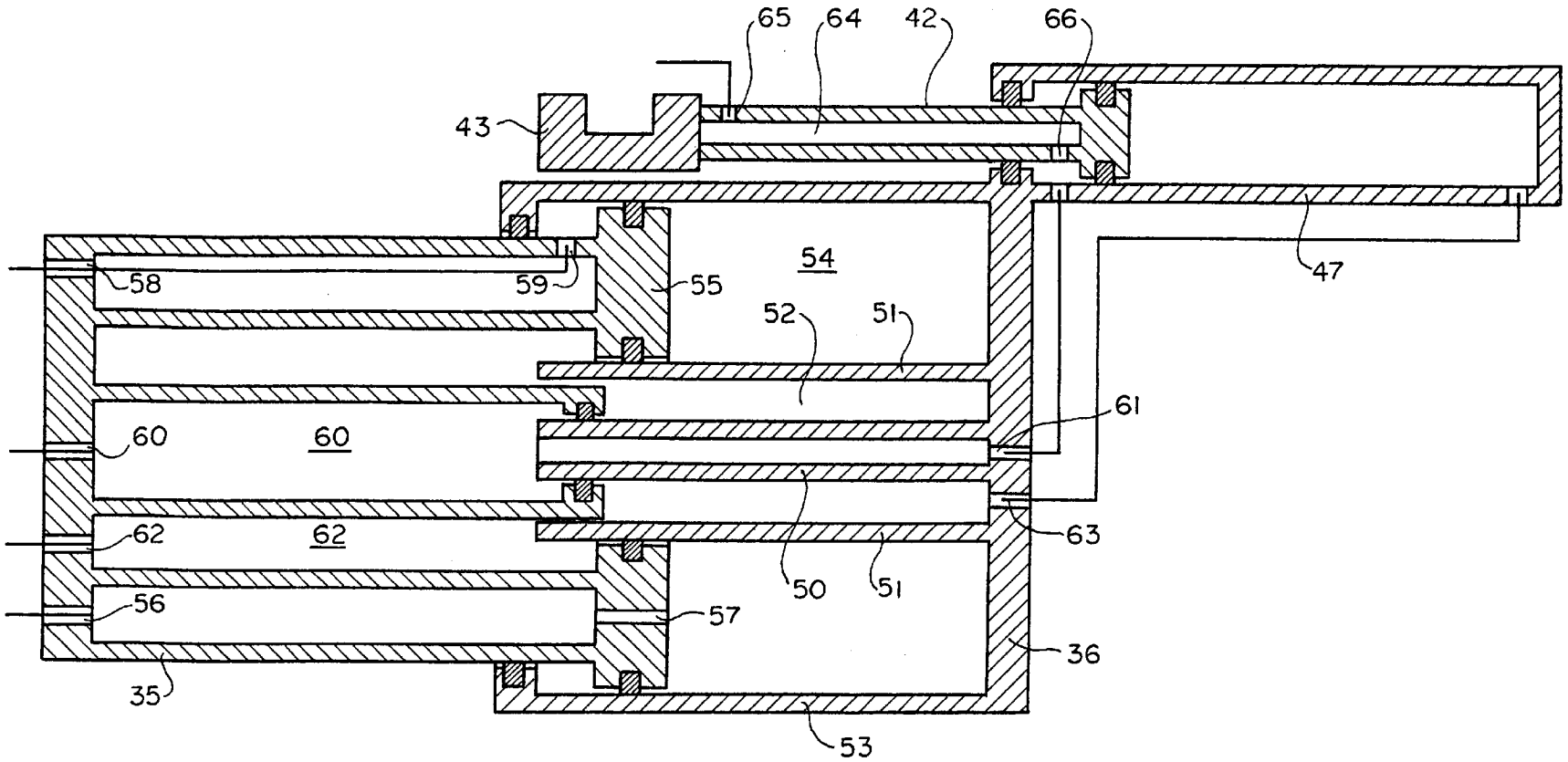

A schematic cross-sectional representation of the telescoping cylinder 36, of the piston rod firmly attached to the foot piece of the boom guide segment and of the auxiliary cylinder 41, connected to the telescoping cylinder 36, is shown in FIG. 15. The telescoping cylinder 36 is provided with two pipes 50, 51 concentric with its center line, of which pipe 51 encloses pipe 50 forming an annular space 52. Between the pipe 51 and the cylinder casing 53 of the telescoping cylinder 36 there is formed an annular space 54 in which the piston 55 is moved. The piston rod 35 and the piston 55 are provided with holes 56, 67 through which pressure oil is supplied to the annular space 54 to extend the cylinder 55. In order to retract the piston, oil under pressure is fed to the opposing piston side through the holes 58, 59 of the piston rod 35. The auxiliary cylinder 41 is fed with oil under pressure, on the one hand, through the holes 60 of the piston rod, the internal pipe 50 and the hole 61 in the floor of the telescoping cylinder and, on the other hand, through the hole 62 of the piston rod 65 and the annular space 52 between the pipes 50 and 51 and the hole 63 in the floor of the telescoping cylinder 36.

Also, the piston rod 42 of the auxiliary cylinder 41 is provided with holes 64 through 66, so that in the movable sleeve and therefore in the coupling and locking devices, oil can be supplied to operate them.

The oil supply can be achieved using a control device, preferably provided with a microprocessor, so that the coupling of the individual segments as well as the pulling and releasing of the individual pins connecting the segments to each other, take place, in each case, in the desired sequence.

What is claimed is:

1. Crane with a telescopic boom having segments (5,6) structured and arranged to be telescoped out of a base boom (4) provided with a boom guide piece (3) affixed thereto, said segments (5,6) arranged to be locked in extended or retracted positions by locking pins (7,8) and, after the release of the locking pins (7,8), extended and retracted by a single-stage hydraulic piston-cylinder unit (1,2), one end of which is fastened to the boom guide piece (3), with two strokes such that each said segment (5,6) which is to be extended or retracted is coupled with an inside and outside end area of a moveable portion of the piston-cylinder unit (1,2), wherein a rod (1) of the piston forming the piston-cylinder unit (1,2) is fastened to the boom guide piece (3), a movable ring or hollow sleeve (9) is placed on a cylinder (2) of the piston-cylinder unit (1,2), and a coupling device is arranged to couple the segments (5,6) to the cylinder (2) to be locked to the internal end and the external end area of the cylinder (2), said coupling device arranged to extend and retract between a position on the inside portion of the cylinder (2) and a position on the outside portion of the cylinder (2).

2. A crane according to claim 1, wherein a device is additionally provided to bring the ring or sleeve (9) with the coupling device thereto from an outside position to an inside position and vice versa.

3. A crane according to claim 1, wherein the telescoping cylinder (2, 36) is additionally supplied with hydraulic oil through holes in the piston rod (1, 25) and an auxiliary cylinder (41) is connected with the telescoping cylinder (2, 36) and comprises a piston rod (42) arranged to push the ring or sleeve (9,43).

4. A crane according to claim 3 wherein the auxiliary cylinder (41) is arranged to be fed hydraulic oil through the telescoping cylinder (36).

5. A crane according to claim 4, wherein a piston rod (42) of the auxiliary cylinder (41) is provided with a hole (64 to 66) to feed hydraulic oil to the ring or sleeve (43).

6. A crane according to claim 1, wherein the coupling device is structured and arranged to be controlled in such a manner that the sleeve (9) carrying the same relative to the telescoping cylinder (2) is movable only when the individual segments (5,6) are locked to each other by spring driven pins (7,8: 44 through 47).

7. A crane according to claim 1, wherein said segments (5,6), piston-cylinder unit (1, 2), guide piece (3) and boom (4) are coupled together with each other mechanically in such a manner that the individual segments (5,6) can be released relative to each other only if the ring or sleeve (9) is locked to the cylinder (2) and the ring or sleeve (9) is locked to the appropriate end piece of the segment (5,6).

8. A crane according to claim 1 structured and arranged such that said piston rod (1) is fastened to the boom guiding piece (3) of the base boom (4) which forms an outer annular segment of the telescopic boom, said cylinder (2) being movably mounted upon said piston rod (1) to telescopically extend out from and retract thereover, said sleeve (9) being provided upon a forward end of said cylinder (2) and provided with claws (10) arranged to lock the sleeve (9) upon one of the two collars (11,12) located upon opposite ends of the cylinder (2), said sleeve (9) also provided with means for coupling the segments (5,6) to the cylinder (2) through locking pins (7,8) and holes in the segments (5,6), said holes being provided on ends and a middle thereof, such that in order to extend said segments (5,6), said innermost segment (6) is coupled (8) to an innermost end of said cylinder (2) which moves the segment (6) to approximately one-half full extension, said cylinder (2) then being uncoupled from said segment (6), retracted and then coupled at an outermost end thereof to an innermost end of said segment (6), and said cylinder (2) is then extended to fully extend said segment (6) in two strokes.

9. The crane of claim 8, additionally comprising a device for moving said cylinder (2, 36) and comprising an auxiliary piston-cylinder unit comprising an auxiliary piston-rod (42) arranged to push said sleeve (9) on the telescoping cylinder (2, 36), said telescoping cylinder (36) being provided with two pipes (50, 51) concentric with a center line thereof, and forming an annular space (52) therebetween, and an outer annular space (54) in which the piston (55) mounted upon the piston rod (1,35) is situated, said piston (55) and rod (35) being provided with holes (56, 57) through which pressure oil is supplied to extend cylinder (36) and holes (56, 57) through which pressure oil is fed to retract the cylinder (36), said auxiliary cylinder (41) being fed with oil through holes (60) of the piston rod (35), internal pipe (50) and hole (61) in the telescoping cylinder (36) and through a hole (62) of the piston rod (35), annular space (52) defined between the pipes (50,51) and a second hole (63) in the telescoping cylinder (36), the auxiliary piston rod (42) also being provided with holes (64–66) for flow of oil to operate the same.

10. A crane with a telescopic boom having segments (5,6) structured and arranged to be telescoped out of a base boom (4) provided with a boom guide piece (3) affixed thereto, said segments (5,6) arranged to be locked in extended or retracted positions by locking pins (7,8) and, after the release of the locking pins (7,8), extended and retracted by a single stage hydraulic piston-cylinder unit (1,2), one end of which is fastened to the boom guide piece (3), with two strokes such that each said segment (5,6) which is extended or retracted is coupled with an inside or outside end area of a movable portion of the piston-cylinder unit (1,2), wherein a cylinder (2) of the piston-cylinder unit (1,2) is fastened to the boom guide piece (3), a piston rod (1) is movably mounted within the cylinder (2) and comprises, at an end thereof, a cage (22) invertingly mounted to move, with the piston rod (1), about the cylinder (2), a movable ring or piece (23) is mounted upon the cage (22), and a coupling device is arranged to couple the segments (5,6) to the cage (22), said coupling device arranged to extend and retract between a position on the inside portion of the cylinder (2) and a position on the outside portion of the cylinder (2).

11. The crane according to claim 10, wherein the cage (22) is constituted by a concentric pipe coupled to the piston rod (1) end and arranged to concentrically move about the cylinder (2) and the ring or piece (23) and coupling device are arranged to couple the segments (5, 6) either to the inner or outer end areas of the pipe.

12. A crane according to claim 10, wherein the coupling device is structured and arranged to be controlled in such a manner that the piece (23) is carrying the same relative to the cage (22) is movable only when the individual segments (5,6) are locked to each other by spring-driven pins (7,8: 44-through 47).

13. A crane according to claim 10, wherein said segments (5,6), piston-cylinder unit (1, 2), guide piece (3) and boom (4) are locked together with each other mechanically in such a manner that the individual segments (5,6) can be released relative to each other only if the ring or moving piece (23) is locked to the cage (22) and the ring or moving piece (22) is locked to the appropriate end piece of the segment (5,6).

14. A crane according to claim 10 structured and arranged such that said piston cylinder (2) is fastened to the boom guiding piece (3) of the base boom (4) which forms an outer annular segment of the telescopic boom, said piston rod (1) being movably mounted upon said cylinder (2) to telescopically extended out from and retract thereinto, said ring (23) being provided upon a forward or rear end of said cage (22) and provided with claws (10) arranged to lock the ring (23) upon the cage (22), said ring (23) also provided with means for coupling the segments (5,6) to the cage (22) through locking pins (7,8) and holes in the segment (5,6), said holes being provided on ends and a middle thereof, such that in order to extend said segments (5,6), said innermost segment (6) is coupled (8) to an innermost end of said cage (22) which moves the segment (6) to approximately one-half full extension, said cage (22) then being uncoupled from said segment (6), retracted and then coupled at an outermost end to an innermost end of said segment (6), and said cage (22) is then extended to fully extend said segment (6) in two strokes.

* * * * *